US010611162B2

(12) United States Patent
Ikebe et al.

(10) Patent No.: US 10,611,162 B2
(45) Date of Patent: Apr. 7, 2020

(54) LIQUID CONTAINER AND LIQUID EJECTION APPARATUS

(71) Applicant: CANON KABUSHIKI KAISHA, Tokyo (JP)

(72) Inventors: Norihiro Ikebe, Kawasaki (JP); Ryo Shimamura, Yokohama (JP); Akira Shiba, Machida (JP); Kazuya Yoshii, Yokohama (JP); Takeho Miyashita, Yokohama (JP); Tomoki Yamamuro, Kawasaki (JP); Atsushi Arai, Yokohama (JP); Masatoshi Ohira, Fujisawa (JP); Tatsuaki Orihara, Tokyo (JP); Hirofumi Okuhara, Tokyo (JP); Kazumasa Matsushita, Kawasaki (JP); Misato Furuya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/140,314

(22) Filed: Sep. 24, 2018

(65) Prior Publication Data

US 2019/0023019 A1 Jan. 24, 2019

Related U.S. Application Data

(62) Division of application No. 15/489,437, filed on Apr. 17, 2017, now Pat. No. 10,112,403.

(30) Foreign Application Priority Data

Apr. 22, 2016 (JP) ..... 2016-086465

(51) Int. Cl.
*B41J 2/175* (2006.01)
*B41J 29/13* (2006.01)

(52) U.S. Cl.
CPC ..... *B41J 2/17523* (2013.01); *B41J 2/1752* (2013.01); *B41J 2/17509* (2013.01); *B41J 2/17553* (2013.01); *B41J 29/13* (2013.01)

(58) Field of Classification Search
CPC ..... B41J 2/175; B41J 2/17509; B41J 2/1752; B41J 2/17523; B41J 2/17553; B41J 29/13
See application file for complete search history.

(56) References Cited

U.S. PATENT DOCUMENTS 5,162,817 A 11/1992 Tajika et al. ..... 347/7
5,179,389 A 1/1993 Arai et al. ..... 347/7
(Continued)

FOREIGN PATENT DOCUMENTS

JP H05-19144 U 3/1993
JP 2005-219483 8/2005
(Continued)

OTHER PUBLICATIONS

Office Action dated Feb. 18, 2020 in counterpart JP Application No. 2016-086465, together with English translation thereof.

*Primary Examiner* — Anh T Vo
(74) *Attorney, Agent, or Firm* — Venable LLP

(57) ABSTRACT

There are provided a liquid container including a plug member which prevents leakage of a liquid from the liquid container and can be opened without scattering the liquid and a liquid ejection apparatus including the liquid container. For that purpose, a projecting portion in the plug member is provided below a center part of the plug member in a gravity direction in an attitude at the time of use of the liquid ejection apparatus.

21 Claims, 14 Drawing Sheets

(56) References Cited

U.S. PATENT DOCUMENTS

| | | | | |
|---|---|---|---|---|
| 5,355,158 | A | 10/1994 | Inada et al. | 347/22 |
| 5,381,169 | A | 1/1995 | Arai et al. | 347/33 |
| 5,398,054 | A | 3/1995 | Fukazawa et al. | 347/33 |
| 5,534,898 | A | 7/1996 | Kashino et al. | 347/33 |
| 5,606,354 | A | 2/1997 | Bekki et al. | 347/33 |
| 5,613,616 | A | 3/1997 | Monus | 220/791 |
| 5,646,655 | A | 7/1997 | Iwasaki et al. | 347/17 |
| 5,748,207 | A | 5/1998 | Inui et al. | 347/43 |
| 5,777,649 | A | 7/1998 | Otsuka et al. | 347/94 |
| 5,831,652 | A | 11/1998 | Hinami et al. | 347/86 |
| 5,980,021 | A | 11/1999 | Nagoshi et al. | 347/49 |
| 5,984,449 | A | 11/1999 | Tajika et al. | 347/15 |
| 5,988,783 | A | 11/1999 | Tajika et al. | 347/7 |
| 6,015,203 | A | 1/2000 | Arai et al. | 347/33 |
| 6,050,669 | A | 4/2000 | Yano et al. | 347/23 |
| 6,241,350 | B1 | 6/2001 | Otsuka et al. | 347/94 |
| 6,314,866 | B1 | 11/2001 | Melton | 99/322 |
| 6,345,888 | B1 | 2/2002 | Matsumoto et al. | 347/86 |
| 6,394,503 | B1 | 5/2002 | DeFosse et al. | 285/136.1 |
| 6,402,308 | B1 | 6/2002 | Hattori et al. | 347/86 |
| 6,476,926 | B1 | 11/2002 | Yano et al. | 358/1.14 |
| 6,505,923 | B1 | 1/2003 | Yamamoto et al. | 347/85 |
| 6,719,395 | B2 | 4/2004 | Iwasaki et al. | 347/19 |
| 7,175,042 | B2 | 2/2007 | Durdon | 220/254.3 |
| 7,175,264 | B2 | 2/2007 | Qingguo | 347/85 |
| 8,454,139 | B2 | 6/2013 | Ishizawa et al. | 347/85 |
| 8,529,035 | B2 | 9/2013 | Tsukamoto et al. | 347/86 |
| 8,529,037 | B2 | 9/2013 | Miyashita et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 8,960,875 | B2 | 2/2015 | Shiba et al. | 347/93 |
| 9,016,842 | B2 | 4/2015 | Miyashita et al. | 347/86 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 9,475,298 | B2 * | 10/2016 | Osakabe | B41J 2/1752 |
| 9,597,884 | B2 | 3/2017 | Nanjo et al. | B41J 2/17546 |
| 9,707,768 | B2 | 7/2017 | Nishimaki et al. | B41J 2/1752 |
| 10,112,403 | B2 * | 10/2018 | Ikebe | B41J 2/17523 |
| 2005/0174408 | A1 | 8/2005 | Qingguo et al. | 347/97 |
| 2011/0209335 | A1 | 9/2011 | Yamamoto et al. | 29/505 |
| 2012/0013687 | A1 | 1/2012 | Ishizawa et al. | 347/85 |
| 2014/0043408 | A1 * | 2/2014 | Kudo | B41J 2/175 347/86 |
| 2015/0022599 | A1 * | 1/2015 | Nozawa | B41J 2/17503 347/86 |
| 2015/0306882 | A1 | 10/2015 | Kudo et al. | B41J 17/523 |
| 2015/0343793 | A1 | 12/2015 | Takada et al. | B41J 2/17556 |
| 2015/0352851 | A1 | 12/2015 | Shiba et al. | B41J 2/17513 |
| 2016/0200114 | A1 | 7/2016 | Nanjo et al. | B41J 2/17546 |
| 2016/0347078 | A1 | 12/2016 | Kato et al. | B41J 2/175 |
| 2017/0087863 | A1 | 3/2017 | Miyashita et al. | B41J 2/17553 |
| 2017/0096010 | A1 | 4/2017 | Nanjo et al. | B41J 2/17546 |
| 2017/0120606 | A1 | 5/2017 | Koshikawa et al. | B41J 2/1754 |
| 2017/0120613 | A1 | 5/2017 | Ikebe et al. | B41J 2/17553 |
| 2017/0136776 | A1 | 5/2017 | Shiba et al. | B41J 2/17566 |
| 2017/0151797 | A1 | 6/2017 | Hayashi et al. | B41J 2/17513 |
| 2017/0151803 | A1 | 6/2017 | Yoshii et al. | B41J 2/17566 |
| 2017/0305164 | A1 | 10/2017 | Orihara et al. | B41J 2/17523 |
| 2017/0305166 | A1 | 10/2017 | Shimamura et al. | B41J 2/17523 |
| 2017/0326882 | A1 | 11/2017 | Okude et al. | B41J 2/17506 |
| 2017/0361619 | A1 | 12/2017 | Arai et al. | B41J 2/17523 |
| 2018/0001650 | A1 | 1/2018 | Miyashita et al. | B41J 2/17523 |

FOREIGN PATENT DOCUMENTS

| | | |
|---|---|---|
| JP | 2007-008539 | 1/2007 |
| JP | 2012-020497 A | 2/2012 |
| JP | 2012-126100 | 7/2012 |
| JP | 2014-037057 | 2/2014 |

* cited by examiner

LIQUID CONTAINER AND LIQUID EJECTION APPARATUS

This application is a division of application Ser. No. 15/489,437 filed Apr. 17, 2017, currently pending; and claims priority under 35 U.S.C. § 119 to Japan Application 2016-086465 filed in Japan on Apr. 22, 2016; and the contents of all of which are incorporated herein by reference as if set forth in full.

BACKGROUND OF THE INVENTION

Field of the Invention

The present invention relates to a liquid container capable of containing a liquid and a liquid ejection apparatus including it.

Description of the Related Art

The liquid ejection apparatus used at present includes a liquid ejection head for ejecting a liquid and a liquid container for storing a liquid to be supplied to the liquid ejection head in general. The liquid is supplied from the liquid container to the liquid ejection head through a tube or a liquid flow passage.

On the other hand, Japanese Patent Laid-Open No. 2012-20497 discloses a liquid ejection apparatus which includes a liquid container having a capacity larger than that of a liquid ejection apparatus of a type supplying the liquid from the liquid container to the liquid ejection head as above and pours the liquid through an inlet included in the liquid container. The liquid container included in the liquid ejection apparatus in Japanese Patent Laid-Open No. 2012-20497 includes the inlet for pouring the liquid and a plug member for preventing leakage of the liquid from the inlet. The plug member has a structure of detachable attachment to the inlet and is removed from the inlet when the liquid is to be poured, while it is attached to the inlet for preventing the liquid from leaking out at time other than the above.

The plug member is attached to the liquid container by being press-fitted to the inlet and prevents leakage of the liquid from the liquid container. When the plug member is to be removed from the inlet of the liquid container, it is removed by pinching and pulling a lug portion provided on the plug member, but the plug member is press-fitted to the inlet, and it is removed against a friction force acting on the whole periphery of a press-fitted portion of the plug member. Therefore, a strong force is required when the plug member is to be removed. Moreover, when the plug member is removed, the friction force is lost at once at the press-fitted portion and thus, the plug member is removed vigorously, which leads to a problem that the liquid in the liquid container is scattered to the outside.

SUMMARY OF THE INVENTION

Thus, the present invention provides a liquid container including a plug member which prevents leakage of the liquid from the liquid container and can be opened without scattering the liquid and a liquid ejection apparatus including the liquid container.

Thus, a liquid container of the present invention is the one including a containing chamber configured to contain a liquid, a supply port capable of supplying the liquid into the containing chamber, and a plug member detachably attached to the supply port, wherein the plug member includes a body portion located outside of the containing chamber and the supply port in a state attached to the supply port; the body portion includes a covering portion covering an opening surface of the supply port in the state of the plug member and a projecting portion projecting from the covering portion; and in an attitude of the liquid container in a case where the plug member is to be removed from the supply port, the projecting portion projects from below a gravity center of the covering portion in a gravity direction seen from a direction orthogonal to the opening surface in the state of the plug member.

According to the present invention, it is possible to realize the liquid container including a plug member which prevents leakage of the liquid from the liquid container and can be opened without scattering the liquid and the liquid ejection apparatus including the liquid container.

Further features of the present invention will become apparent from the following description of exemplary embodiments with reference to the attached drawings.

DESCRIPTION OF THE EMBODIMENTS

First Embodiment

A first embodiment of the present invention will be described below with reference to the attached drawings.

Figure 1:
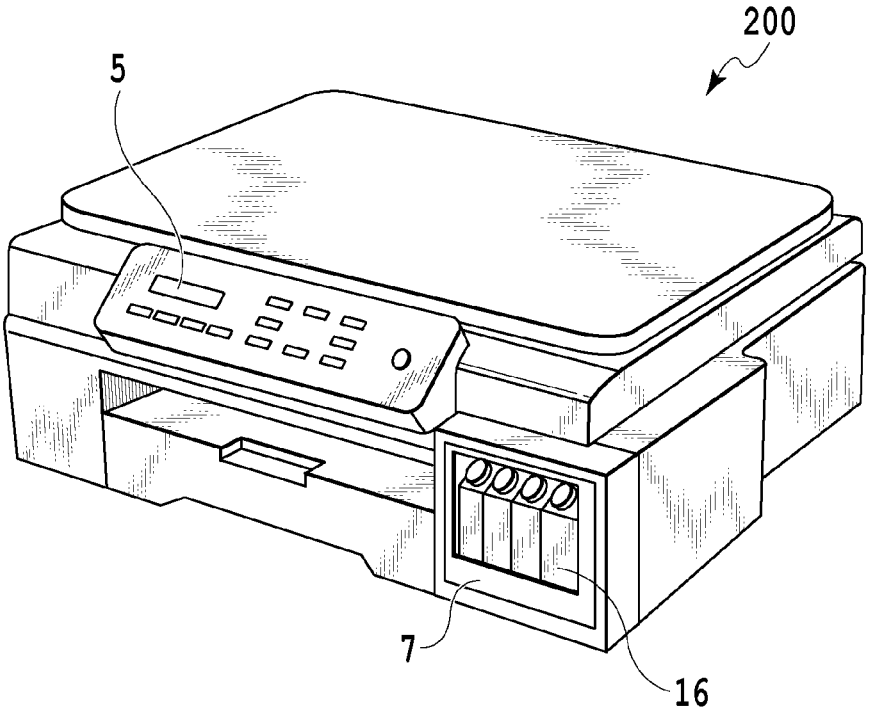
FIG. 1 is a perspective view illustrating a mechanism portion of a liquid ejection apparatus.
Figure 2:
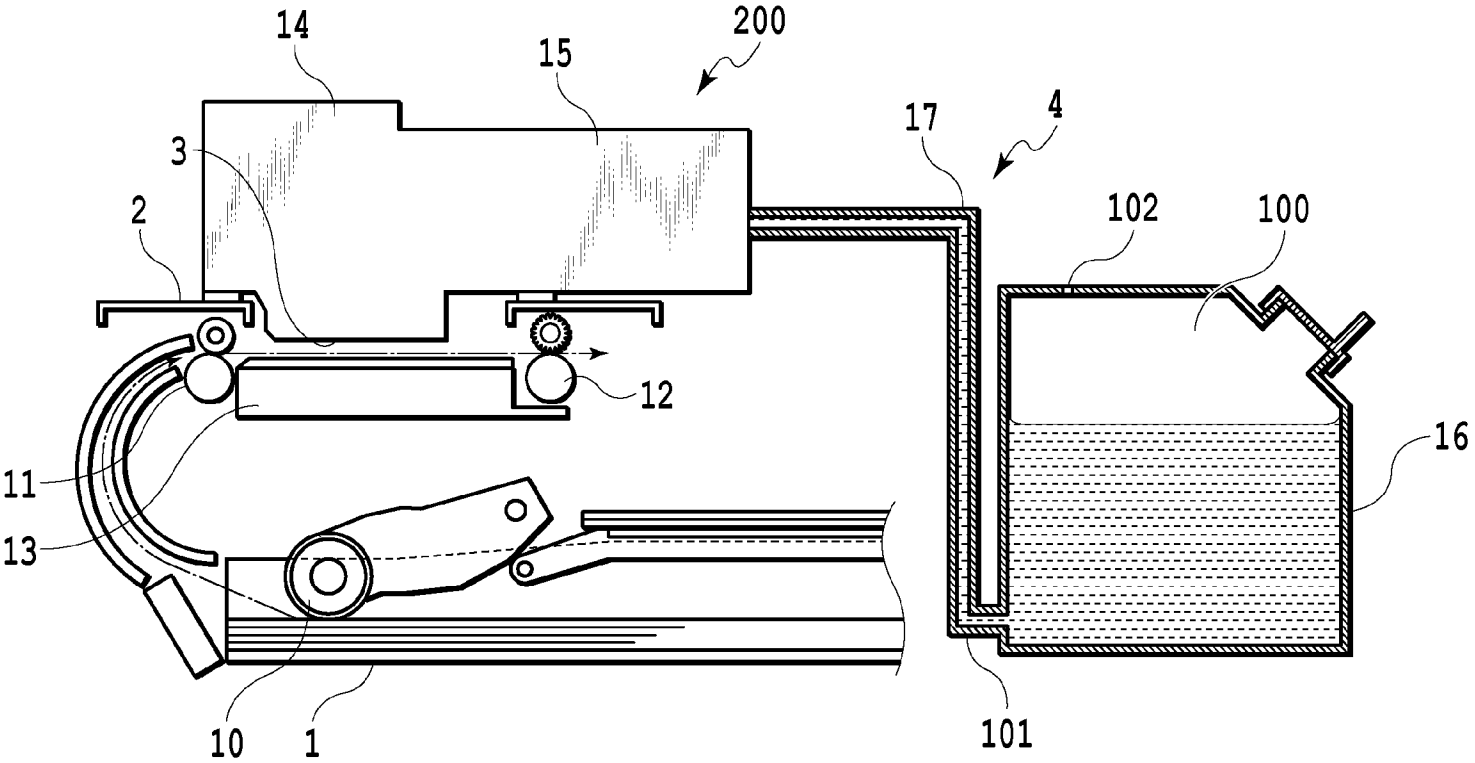
FIG. 2 is a diagram illustrating a section of the liquid ejection apparatus.

FIG. 1 is a perspective view illustrating a mechanism portion of a liquid ejection apparatus 200 to which this embodiment can be applied, and FIG. 2 is a diagram illustrating a section of the liquid ejection apparatus 200. The liquid ejection apparatus 200 includes a feeding portion 1, a conveyance portion 2, an ejection portion 3, a supply portion 4, and a display portion 5. The feeding portion 1 separates print mediums one by one from a bundle of the print mediums by using a feeding roller 10 and supplies it to the conveyance portion 2. The conveyance portion 2 is provided on a downstream side in a conveyance direction of the feeding portion 1 and includes a platen 13 for holding the print medium between a conveyance roller 11 and a discharge roller 12. The conveyance portion 2 conveys the print medium fed from the feeding roller 10 by using the conveyance roller 11, the discharge roller 12 and the like.

The ejection portion 3 ejects the liquid to the print medium by a liquid ejection head 15 mounted on a carriage 14. The print medium having been conveyed by the conveyance portion 2 is supported by the platen 13 from vertically below. Then, the liquid ejection head 15 located vertically above ejects the liquid to form an image based on image information. A liquid container 16 can contain a liquid in a container, and the supply portion 4 is constituted capable of supplying the liquid from a storage chamber 100 (containing chamber) of the liquid container 16 to the liquid ejection head 15 through a flow passage 101 and a flexible supply tube 17.

In this embodiment, the liquid is ink and in more detail, four supply tubes 17 through which ink in each of colors (black, magenta, cyan, yellow) flows are extended from the liquid container 16, and they are connected to the liquid ejection head 15 in a bundled state. In a case where the liquid supplied to the liquid ejection head 15 is ejected from an outlet of the liquid ejection head 15, a liquid in an amount equal to the ejected amount is supplied by the liquid container 16 to the liquid ejection head 15. Then, air in an amount equal to the liquid supplied to the liquid ejection head 15 flows into the liquid container 16 through an atmospheric communication port 102 provided vertically above the liquid container 16. The display portion 5 is used for notifying a state of the apparatus in operation to a user or for display at operation selection by the user.

Figure 3:
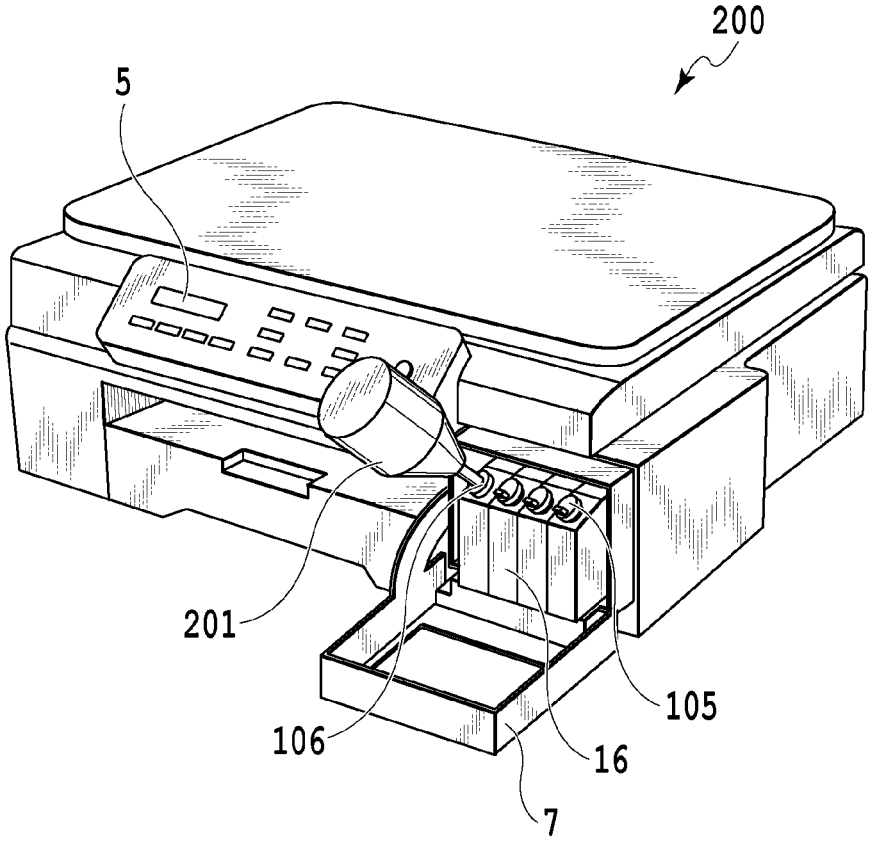
FIG. 3 is a perspective view illustrating the liquid ejection apparatus in which a liquid is replenished by a liquid replenishing container.

FIG. 3 is a perspective view illustrating the liquid ejection apparatus 200 in which the liquid is replenished by a liquid replenishing container 201. As illustrated in the figure, in the liquid ejection apparatus 200 of this embodiment, when the liquid is to be supplied, a container cover 7 is opened, and the liquid is supplied into the storage chamber 100 through a supply port 106 included in the liquid container 16 from the liquid replenishing container 201. A plug member 105 detachable relative to the supply port 106 is provided at the supply port 106, and when replenishment is to be performed by the liquid replenishing container 201, the plug member 105 of the supply port 106 is removed for supply of the liquid. Note that the liquid container 16 is not limited to a constitution incorporated in the liquid ejection apparatus 200 body as in this embodiment but the liquid container 16 may be provided outside of the liquid ejection apparatus 200 body in a constitution as long as the liquid can be supplied from the liquid container 16 to the liquid ejection head 15.

Figure 4:
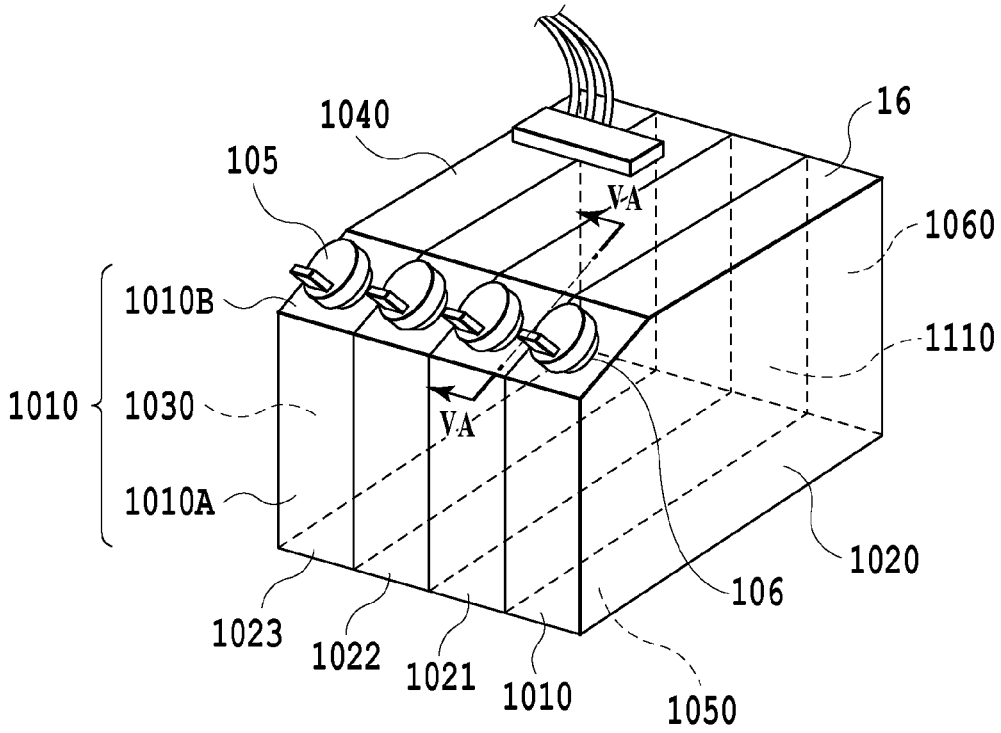
FIG. 4 is a perspective view illustrating a liquid container of the liquid ejection apparatus.

FIG. 4 is a perspective view illustrating the liquid container 16 of the liquid ejection apparatus 200 to which this embodiment can be applied. The liquid container 16 in this embodiment is molded with a synthetic resin, such as polypropylene, and has a substantially cuboid outline shape. The liquid container 16 has a front wall 1010, a right wall 1020, a left wall 1030, an upper wall 1040, and a lower wall 1050. The front wall 1010 is constituted by a standing wall 1010A extending substantially vertically from the lower wall 1050 and an inclined wall 1010B (an example of an outer wall) joined to an upper end of the standing wall 1010A and inclined to the vertical direction and a longitudinal direction. The inclined wall 1010B is inclined to a rear side relative to the standing wall 1010A, and the supply port 106 is formed on this inclined wall 1010B.

On the other hand, a rear surface of the liquid container 16 is open. Further, a film 1060 is welded to rear end portions of the right wall 1020, the left wall 1030, inter-color walls 1021, 1022, and 1023, the upper wall 1040, and the lower wall 1050, and thereby to seal the liquid container 16 and form a rear wall which is a rear surface. That is, the rear wall of the liquid container 16 is formed by the film 1060. A liquid chamber 1110 is thus formed.

Figure 5A:
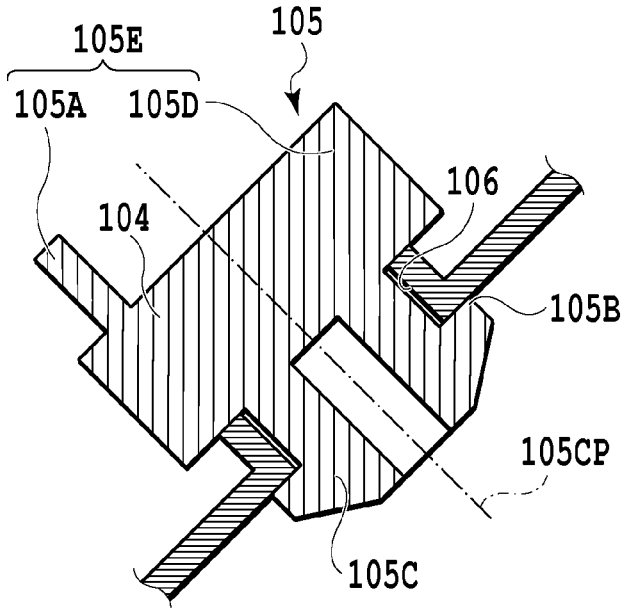
FIG. 5A is a diagram illustrating an embodiment of a plug member.
Figure 5B:
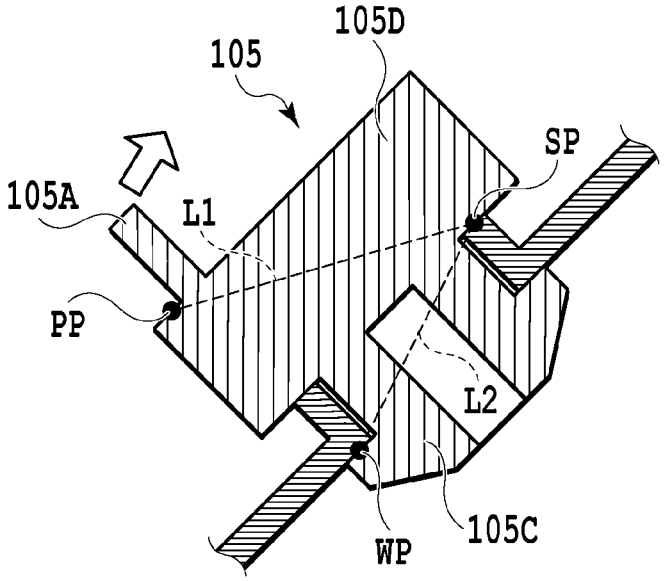
FIG. 5B is a diagram illustrating the embodiment of the plug member.

FIGS. 5A and 5B are diagrams each illustrating a section at VA-VA in FIG. 4 and diagrams each illustrating an embodiment of the plug member 105 in the present invention. FIG. 5A illustrates a state where the plug member 105 is attached to the supply port 106, and since the plug member 105 is press-fitted to the supply port 106 in order to obtain sealing performances for preventing liquid leakage, it is formed of a flexible member, such as rubber, in general. The plug member 105 includes a body portion 105E located outside of the storage chamber 100 and the supply port 106 in a state attached to the supply port 106 and a plug portion 105C inserted into the supply port 106 to close the supply port 106. The plug member 105 is elastically deformed and attached so as to sandwich the supply port 106 from the vertical direction.

The body portion 105E in this embodiment includes a projecting portion 105A capable of applying a force by a user to the plug member 105 when it is to be removed from the supply port 106 and a covering portion 105D covering an opening surface of the supply port 106. The projecting portion 105A is provided projecting from an upper surface 104 of the covering portion 105D of the plug member 105. Note that the upper surface 104 is provided along the opening surface of the supply port 106 in a state where the plug member 105 is attached to the supply port 106. The projecting portion 105A in this embodiment is provided below a center part CP (gravity center part) of the plug member 105 in a gravity direction in an attitude of the liquid container 16 when the plug member 105 is to be removed from the supply port 106. Note that the vertical direction in FIG. 5A, FIG. 5B matches the vertical direction in the gravity direction of the plug member 105 in the liquid container 16 when the plug member 105 is to be removed from the supply port 106. Moreover, a figure illustrating a plug member in an embodiment which will be described later is also shown with the directions matched similarly.

Figure 5C:
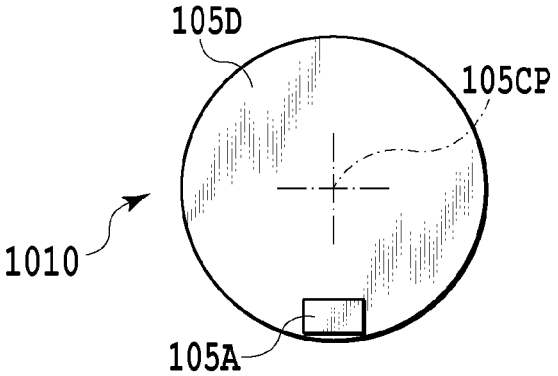
FIG. 5C is a diagram illustrating the embodiment of the plug member.

Arrangement of the projecting portion 105A will be described more specifically by use of FIG. 5C. FIG. 5C is a top view of a state where the plug member 105 is attached to the supply port 106 seen from a direction orthogonal to the supply port 106. In this embodiment, a shape of the upper surface 104 of the covering portion 105D is circular, and a center part 105CP of the plug member 105 is a center part in the upper surface 104 of the covering portion 105D as illustrated in FIG. 5C. Moreover, in this embodiment, since the shape of the upper surface 104 is circular and the center of the upper surface 104 and the gravity center of the upper surface 104 are at the same position, the "center (part)" may be also expressed as the "gravity center (part)" in explanation. Here, in the state where the plug member 105 is attached to the supply port 106, the projecting portion 105A projects from a position below the center part CP (gravity center part) of the plug member 105 in the gravity direction seen from a direction orthogonal to the opening surface of the supply port 106.

Note that, that the projecting portion 105A in this description "projects" refers to a state where the projecting portion 105A sufficiently projects to such a degree that the user can pinch or apply a force thereto. Providing the projecting portion 105A below the center part of the plug member 105 in the gravity direction prompts the user to pull up and remove the projecting portion 105A when the plug member 105 is to be removed from the supply port 106. As described above, the projecting portion 105A provided below the center part of the plug member 105 in the gravity direction is pulled up, and thus the plug member 105 is gradually deformed from a side where the projecting portion 105A is provided and removed from the supply port 106, which allows removal with a relatively weak force. Moreover, since the press-fitted portion has its force gradually released and is removed by deformation of the plug member 105 from one side, the plug member 105 is not removed from the supply port 106 at once, and scattering of the liquid in the liquid container 16 to the outside can be suppressed.

FIG. 5B is a diagram illustrating the plug member 105 to which the force applied by the user acts when the plug member 105 is to be removed. At this time, a relationship of the force applied to the plug member 105 forms the principle of leverage assuming that a root of the projecting portion 105A is a power point PP, a fixed point of the plug member in contact with an upper part of the supply port 106 is a supporting point SP, and a point located at a lower part of the supply port on a side opposite to the supporting point SP is a working point WP. Here, it is assumed that a distance from the supporting point SP to the power point PP is L1 and a distance from the working point WP to the supporting point SP is L2. Taking the distance L1 longer than the distance L2 (distance L1>distance L2) increases a small force applied to the power point PP to form a large force at the working point WP, and allows the plug member 105 to be removed from the supply port 106 without requiring a strong force.

Moreover, in a case where the liquid ejection apparatus 200 is installed at a relatively low position, it is expected that the user usually removes the plug member 105 by an operation of pulling up the projecting portion 105A upward in the gravity direction. Therefore, since the projecting portion 105A projects from the lower position in the gravity direction as described above, the distance L1 in the normal removing operation becomes long, and therefore the plug member 105 can be removed easily.

Note that, the shape of the projecting portion 105A is not limited to the above but a spherical shape or a cuboid extended shape may be provided at a tip end of the projecting portion, for example. By provision of an extended shape at the tip end, it can easily catch the finger when the user pinches the projecting portion, which facilitates application of the force to the projecting portion.

Moreover, the upper surface shape of the covering portion 105D is not limited to the circular shape as described above but may be a symmetric shape, such as a rectangle or an asymmetric shape, may be used, for example. In these cases, too, the projecting portion 105A may project from the position below the gravity center of the plug member 105, that is, below a mass center when a mass is uniformly distributed on the upper surface 104 of the covering portion 105D in the gravity direction.

Moreover, in this embodiment, the liquid container 16 is used in a state where its direction in the gravity direction is the same both in use of the liquid ejection apparatus 200 and in pouring of the liquid into the liquid container 16, but the direction of the liquid container 16 is changed in pouring and then, the plug member 105 is removed in some cases.

Moreover, in this embodiment, the constitution in which the plug member includes the body portion and the plug portion is described but this is not limiting, and the plug member may be a so-called cap-type member constituted only by the body portion, not including the plug portion.

As described above, the projecting portion 105A is provided below the center part of the plug member 105 in the gravity direction in the attitude in use of the liquid ejection apparatus 200. As a result, it is possible to realize the liquid container including the plug member which prevents leakage of the liquid from the liquid container and can be opened without scattering the liquid, and the liquid ejection apparatus including the liquid container.

Second Embodiment

A second embodiment of the present invention will be described below with reference to the attached drawings. Note that, since a basic constitution of this embodiment is similar to that of the first embodiment, only characteristic constitution will be described below.

Figure 6:
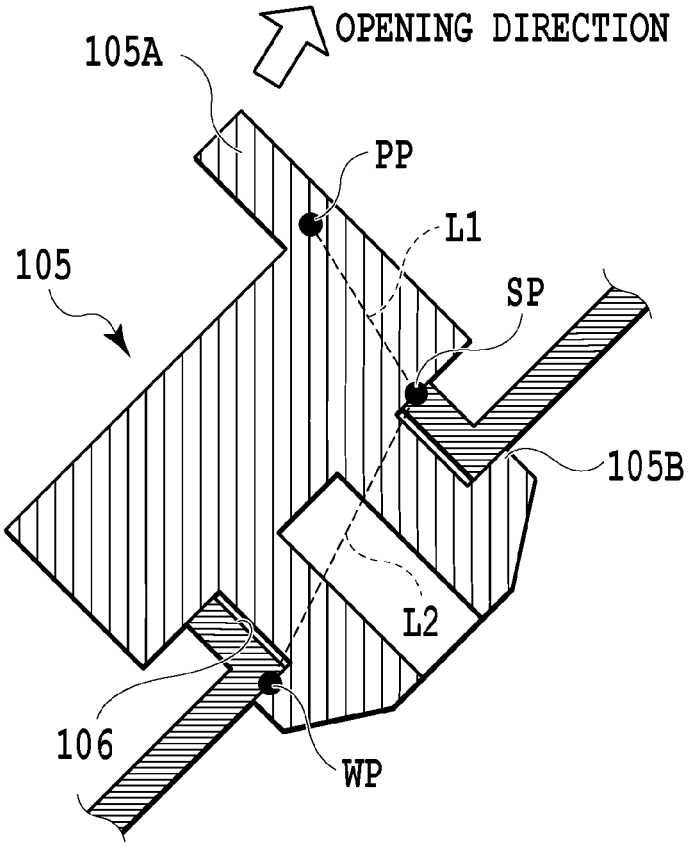
FIG. 6 is a diagram illustrating a state where the plug member is attached upside down.

FIG. 6 is a diagram illustrating a state where the plug member 105 is attached upside down when the plug member 105 is re-attached to the supply port 106 after the user replenished the liquid. In a case where the plug member 105 is attached upside down, the projecting portion 105A is located on an upper part in the gravity direction of the plug member 105 as illustrated in the figure. In this case, in an opposite manner to the normal operation (pulling up), the projecting portion 105A is pulled down, and thereby the plug member 105 can be removed. However, in a case where the liquid ejection apparatus 200 is installed at a relatively low position, it is considered that the projecting portion 105A might be pulled up. In this case, it makes L1<L2 as illustrated in the figure, and an opening force cannot be reduced by the principle of leverage. Thus, in this embodiment, the plug member includes the following constitution.

Figure 7:
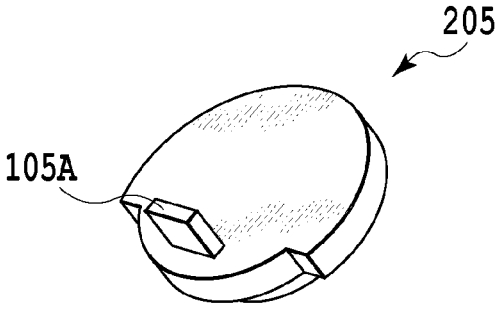
FIG. 7 is a diagram illustrating the plug member.
Figure 8:
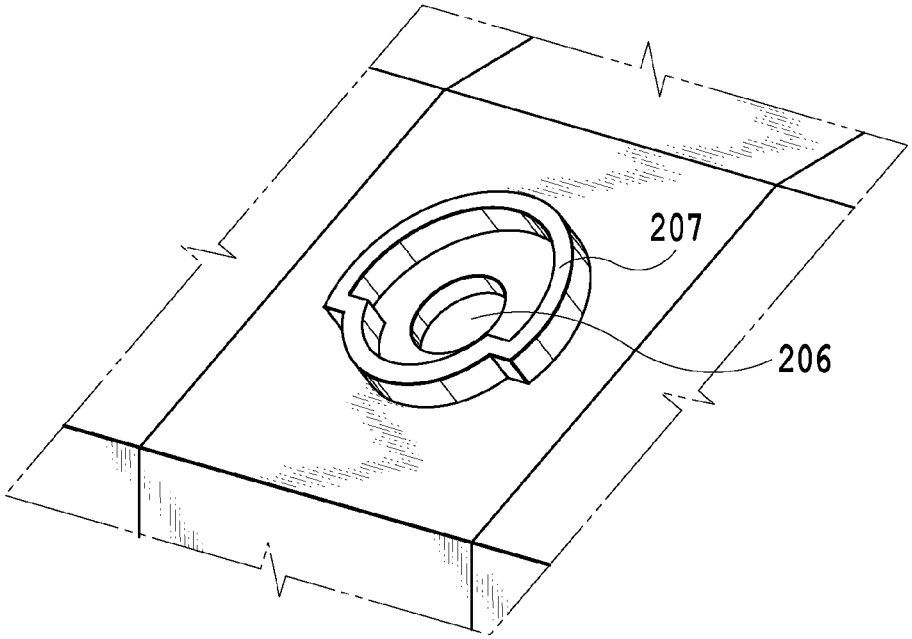
FIG. 8 is a diagram illustrating a supply port.

FIG. 7 is a diagram illustrating a plug member 205 in this embodiment, and FIG. 8 is a diagram illustrating a supply port 206 in this embodiment. The plug member 205 in this embodiment is constituted so that a shape of a surface on which a projecting portion 105A is provided has a vertically asymmetric shape as in FIG. 7. Moreover, the supply port 206 also includes a direction regulating portion 207 so as to follow the shape of the plug member 205 as above. As a result, when the plug member 205 is attached to the supply port 206, the vertical direction of the plug member 205 (in the gravity direction) is regulated by the direction regulating portion 207. Thus, attachment upside down can be prevented, and when the plug member 205 is to be removed, it can be removed by effective use of the principle of leverage.

Note that, a shape of the plug member for preventing opposite attachment is not limited to the shape illustrated in FIG. 7 but only needs to be a shape that can regulate the vertical direction in the gravity direction. For example, it may be constituted such that a notch is provided at a part of the plug member, a projection corresponding to the notch is provided in a vicinity of the supply port or the supply port and the plug portion include a shape capable of insertion only in one direction.

Third Embodiment

A third embodiment of the present invention will be described below with reference to the attached drawings. Note that, since a basic constitution of this embodiment is similar to that of the first embodiment, only characteristic constitution will be described below.

Figure 9:
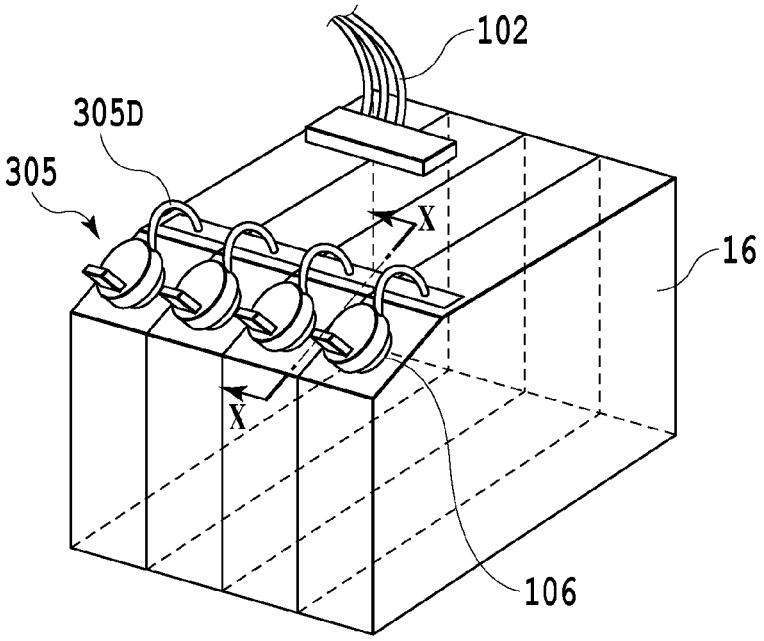
FIG. 9 is a diagram illustrating the liquid container and the plug member.

FIG. 9 is a diagram illustrating the liquid container 16 and a plug member 305 in this embodiment. Since a liquid is contained in the liquid container 16, it is considered that the liquid adheres to a surface on an inner side of the plug member 305 attached to the supply port 106 of the liquid container 16. In a case where the plug member 305 in a state where the liquid adheres thereto is removed and the plug member 305 drops, the adhering liquid may be scattered in the periphery.

Figure 10:
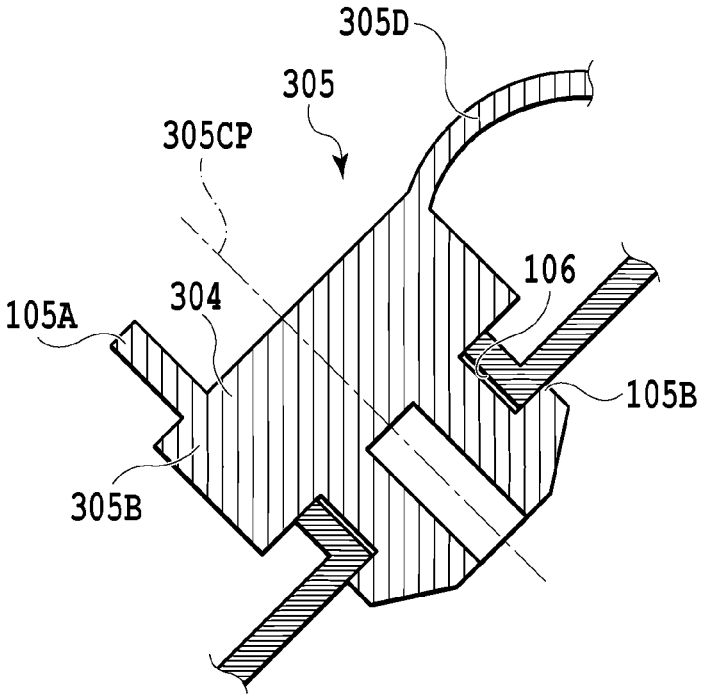
FIG. 10 is a sectional view in X-X in FIG. 9.

FIG. 10 is a sectional view in X-X in FIG. 9 and is a diagram illustrating the plug member 305 in this embodiment. In this embodiment, in order to prevent drop (removal) of the plug member 305, the plug member 305 includes a support portion 305D which can connect the plug member 305 and the liquid container 16. The root part of the projecting portion 105A and the support portion 305D are disposed separately on one side and on the other side while sandwiching a center part 305CP of the plug member 305 between them. That is, the projecting portion 105A and the support portion 305D are disposed on the one side and on the other side while sandwiching a surface including a center axis of the plug member 305 crossing an opening surface of the supply port 106 substantially perpendicularly when the plug member 305 is attached to the supply port 106.

That is, in an attitude of the liquid container 16 when the plug member 305 is to be removed, in a state where the plug member 305 is attached to the supply port 106, the support portion 305D is disposed above a center (gravity center) of a covering portion 305B, in the gravity direction, in an upper surface 304 of the covering portion 305B. Since the plug member 305 is connected to the liquid container 16 by the support portion 305D, the plug member 305 does not drop even if it is removed from the supply port 106, and scattering of the liquid to the periphery can be prevented. Moreover, the attitude of the plug member 305 when the plug member 305 is attached to the supply port 106 by the support portion 305D can be regulated, and upside-down attachment of the plug member 305 can be prevented.

Note that, a connecting target of the plug member 305 by the support portion 305D is not limited to the liquid container 16 but may be anything as long as the plug member 305 does not drop.

Moreover, the support portion 305D may be formed integrally with the plug member 305 or may be formed separately.

Fourth Embodiment

A fourth embodiment of the present invention will be described below with reference to the attached drawings. Note that, since a basic constitution of this embodiment is similar to that of the first embodiment, only characteristic constitution will be described below.

Figure 11:
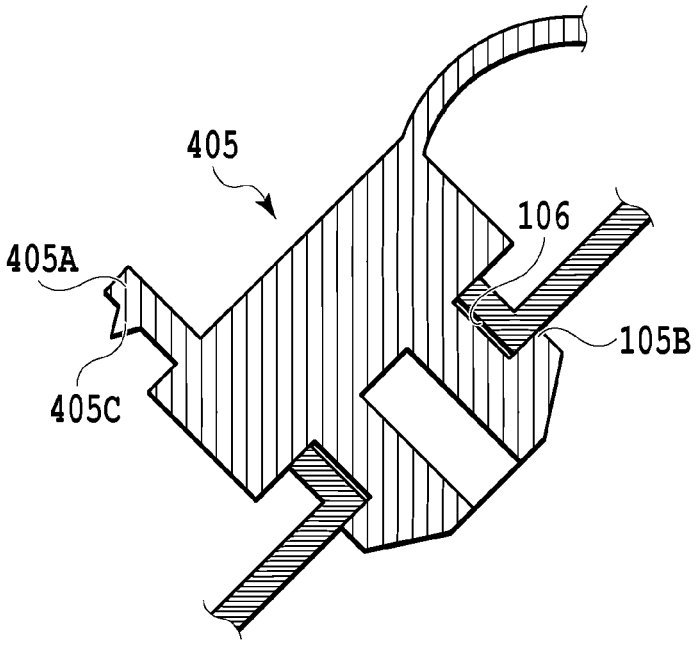
FIG. 11 is a diagram illustrating the plug member.

FIG. 11 is a diagram illustrating a plug member 405 of this embodiment. The plug member 405 of this embodiment includes a friction force increasing portion 405C on a lower surface portion in the gravity direction of a projecting portion 405A, for increasing a friction force upon contact with the projecting portion 405A when the user applies a force to the projecting portion 405A. By means of this friction force increasing portion 405C, the finger is hooked by the friction force increasing portion 405C when the user pulls up the projecting portion 405A and can easily pull it up, and thus, the force for pulling up can be easily adjusted, and scattering of the liquid adhering to the plug member 405 can be further prevented.

Note that, the friction force increasing portion 405C is not limited to the projection as in the figure but only needs to be constituted to increase the friction force such that surface roughness of the projecting portion 405A is made coarse and the like.

Fifth Embodiment

A fifth embodiment of the present invention will be described below with reference to the attached drawings. Note that, since a basic constitution of this embodiment is similar to that of the first embodiment, only characteristic constitution will be described below.

Figure 12:
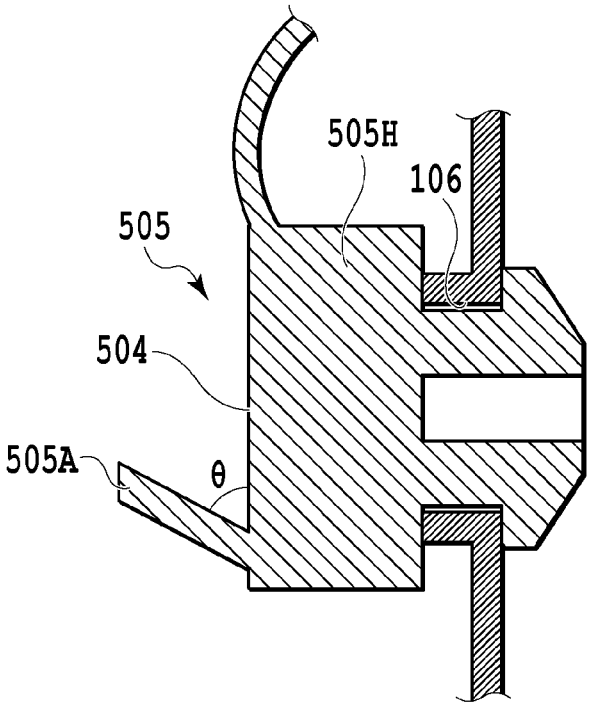
FIG. 12 is a diagram illustrating the plug member.

FIG. 12 is a diagram illustrating a plug member 505 of this embodiment. The plug member 505 of this embodiment is provided with a predetermined angle θ relative to an upper surface 504 along an opening surface of the supply port 106 in a covering portion 505H so that a tip end portion of a projecting portion 505A is directed upward in the gravity direction. By setting of this angle θ to a sharp angle, even if the supply port 106 is installed on a front surface of the liquid container 16, the tip end portion of the projecting portion 505A is directed upward in the gravity direction from the horizontal. As a result, the user can easily pull up the plug member 505 in the gravity direction.

Sixth Embodiment

A sixth embodiment of the present invention will be described below with reference to the attached drawings. Note that, since a basic constitution of this embodiment is similar to that of the first embodiment, only characteristic constitution will be described below.

Figure 13:
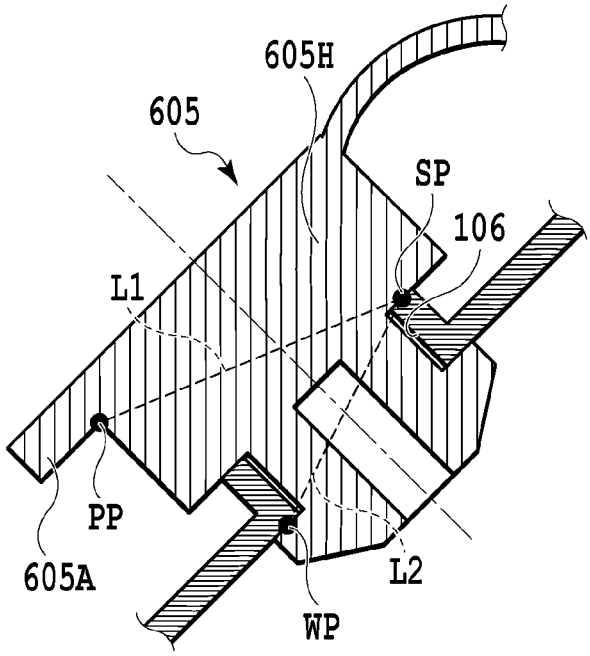
FIG. 13 is a diagram illustrating the plug member.

FIG. 13 is a diagram illustrating a plug member 605 of this embodiment. The plug member 605 of this embodiment includes a projecting portion 605A below a side surface of a covering portion 605H substantially orthogonal to the opening surface of the supply port 106*a* in the gravity direction when the plug member 605 is attached to the supply port 106. By provision of the projecting portion 605A as above, the user can easily pull up the plug member 605 in the gravity direction. Moreover, since a distance L1' between the supporting point SP and the power point PP can be taken longer than the distance L1, the principle of leverage can be utilized more effectively, and the plug member 605 can be removed more easily.

Seventh Embodiment

A seventh embodiment of the present invention will be described below with reference to the attached drawings. Note that, since a basic constitution of this embodiment is similar to that of the first embodiment, only characteristic constitution will be described below.

Figure 14A:
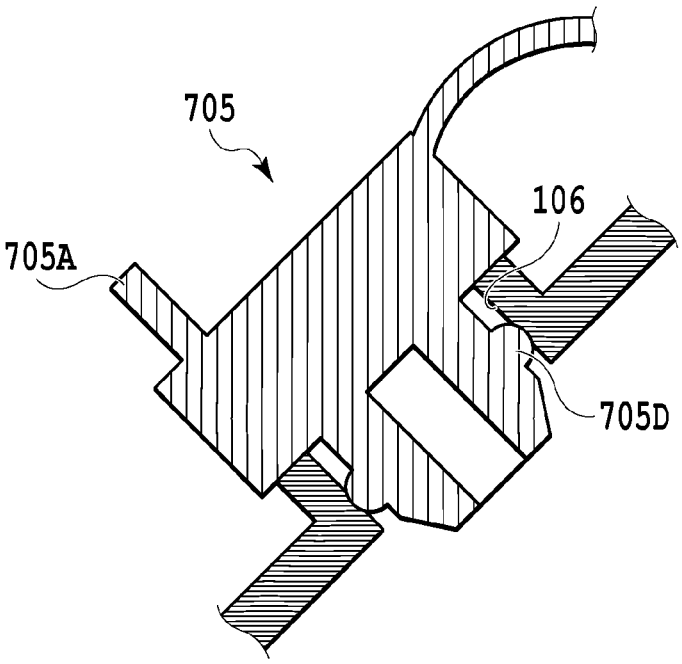
FIG. 14A is a diagram illustrating the plug member.
Figure 14B:
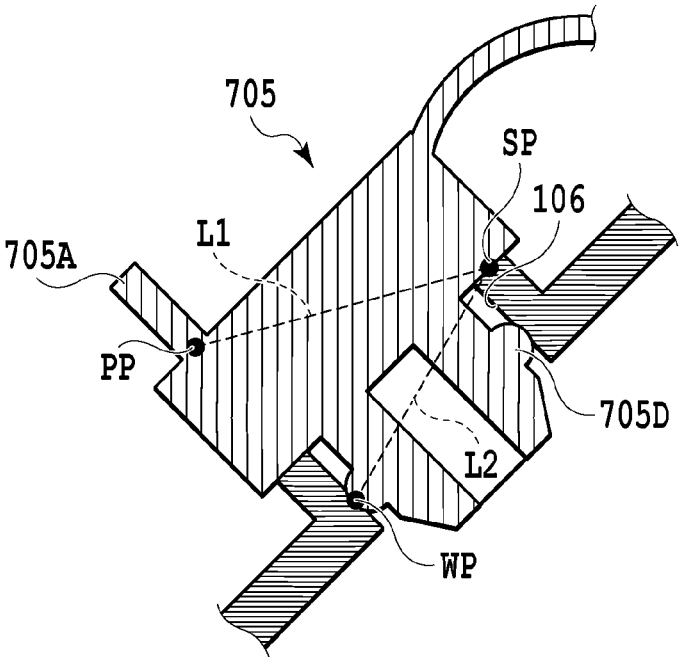
FIG. 14B is a diagram illustrating the plug member.

FIGS. 14A and 14B are diagrams each illustrating a plug member 705 of this embodiment. The plug member 705 of this embodiment has a protruding portion 705D on an outer periphery of a portion to be press-fitted in the plug member 705 so as to be brought into contact with an inner wall of the supply port 106 and to be deformed, and the protruding portion 705D is deformed so as to seal the supply port 106 when the plug member 705 is attached to the supply port 106. Note that, a sectional shape of the protruding portion 705D is preferably an R-shape or a triangular shape, for example.

FIG. 14B is a diagram illustrating a state where a force is applied by the user to the plug member 705 when the plug member 705 is to be opened. When the user applies the force to a projecting portion 705A, a relationship of the force applied to the plug member 705 forms the principle of leverage assuming that a root of the projecting portion is a power point PP, a fixed point of the plug member 705 in contact with the upper part of the supply port 106 is a supporting point SP, and a point located at a lower part of the supply port on a side opposite to the supporting point SP is a working point WP.

According to the plug member 705 of this embodiment, the supply port 106 is sealed by elastic deformation of the protruding portion 705D by press-fitting between the supply port 106 inner wall and the protruding portion 705D. Therefore, the plug member can be removed easily and without scattering the liquid by means of the principle of leverage described above.

Note that, anything in each of the aforementioned embodiments capable of combination may be freely combined in practice.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-086465 filed Apr. 22, 2016, which is hereby incorporated by reference wherein in its entirety.

What is claimed is:

1. A liquid ejection apparatus, comprising:

a liquid ejection head for ejecting a liquid;

a liquid container including a containing chamber configured to contain a liquid supplied to the liquid ejection head and a supply port constructed for supply of the liquid to the containing chamber from an outside; and a cover member including a covering portion and a support portion and a projecting portion, wherein the covering portion has a first state in which the covering portion covers an opening surface of the supply port from the outside of the containing chamber to close the containing chamber and a second state in which the covering portion is removed from the supply port to open the containing chamber, wherein the support portion is connected to another member in the first state and the second state of the covering portion to support the covering portion, and wherein the projecting portion projects relative to the covering portion located outside the containing chamber;

wherein in an attitude of the liquid container in a case where the covering portion is to be removed from the supply port, the projecting portion projects from near an edge of the covering portion located below a gravity center of the covering portion as seen from a direction orthogonal to the opening surface in the first state of the covering portion in a gravity direction, and wherein the projection portion is not provided on the gravity center of the covering portion.

2. The liquid ejection apparatus according to claim 1, wherein in the attitude of the liquid container, the opening surface is inclined with respect to the gravity direction.

3. The liquid ejection apparatus according to claim 1, wherein in the attitude of the liquid container, the opening surface is along the gravity direction.

4. The liquid ejection apparatus according to claim 1, wherein in the attitude of the liquid container, the support portion is disposed above the gravity center in the gravity direction in the first state of the covering portion.

5. The liquid ejection apparatus according to claim 1, wherein the projecting portion has a friction force increasing portion configured to increase a friction force upon contact provided on a lower surface part in the gravity direction in the attitude of the liquid container.

6. The liquid ejection apparatus according to claim 1, wherein the projecting portion protrudes from an upper surface of the covering portion along the opening surface in the first state of the covering portion.

7. The liquid ejection apparatus according to claim 6, wherein the projecting portion is provided with a predetermined sharp angle relative to the upper surface of the covering portion so that a tip end portion is directed upward in the gravity direction in the attitude of the liquid container.

8. The liquid ejection apparatus according to claim 1, wherein the projecting portion protrudes from a side surface of the covering portion substantially orthogonal to the opening surface in the first state of the covering portion.

9. The liquid ejection apparatus according to claim 1, wherein the cover member includes a plug portion inserted into the supply port to close the supply port.

10. The liquid ejection apparatus according to claim 1, wherein the projecting portion is a pinch portion for removing the covering portion from the supply port.

11. The liquid ejection apparatus according to claim 1, wherein the support portion is connected to the liquid container.

12. A liquid container, comprising:

a containing chamber for storing liquid to be supplied to a liquid ejection head;

a supply port for supplying liquid to the containing chamber; and a cover member including a covering portion and a support portion and a projecting portion, wherein the covering portion has a first state in which the covering portion covers an opening surface of the supply port from the outside of the containing chamber to close the containing chamber and a second state in which the covering portion is removed from the supply port to open the containing chamber, wherein the support portion is connected to another member in the first state and the second state of the covering portion to support the covering portion, and wherein the projecting portion projects relative to the covering portion located outside the containing chamber;

wherein in an attitude of the liquid container in a case where the covering portion is to be removed from the supply port, the projecting portion projects from near an edge of the covering portion located below a gravity center of the covering portion as seen from a direction orthogonal to the opening surface in the first state of the covering portion in a gravity direction, and wherein the projection portion is not provided on the gravity center of the covering portion.

13. The liquid container according to claim 12, wherein in the attitude of the liquid container, the opening surface is inclined with respect to the gravity direction.

14. The liquid container according to claim 12, wherein in the attitude of the liquid container, the opening surface is along the gravity direction.

15. The liquid container according to claim 12, wherein in the attitude of the liquid container, the support portion is disposed above the gravity center in the gravity direction in the first state of the covering portion.

16. The liquid container according to claim 12,
wherein the projecting portion has a friction force increasing portion configured to increase a friction force upon contact provided on a lower surface part in the gravity direction in the attitude of the liquid container.

17. The liquid container according to claim 12,
wherein the projecting portion protrudes from an upper surface of the covering portion along the opening surface in the first state of the covering portion.

18. The liquid container according to claim 17,
wherein the projecting portion is provided with a predetermined sharp angle relative to the upper surface of the covering portion so that a tip end portion is directed upward in the gravity direction in the attitude of the liquid container.

19. The liquid container according to claim 12,
wherein the projecting portion protrudes from a side surface of the covering portion substantially orthogonal to the opening surface in the first state of the covering portion.

20. The liquid container according to claim 12,
wherein the cover member includes a plug portion inserted into the supply port to close the supply port.

21. The liquid container according to claim 12,
wherein the projecting portion is a pinch portion for removing the covering portion from the supply port.

* * * * *